US006712181B2

(12) United States Patent
Nichols

(10) Patent No.: US 6,712,181 B2
(45) Date of Patent: Mar. 30, 2004

(54) SAFETY ROPE GRAB DEVICE

(76) Inventor: Steve Nichols, 8522-216th St. SE., Woodinville, WA (US) 98072-8009

( * ) Notice: Subject to any disclaimer, the term of this patent is extended or adjusted under 35 U.S.C. 154(b) by 0 days.

(21) Appl. No.: 10/068,572

(22) Filed: Feb. 7, 2002

(65) Prior Publication Data

US 2002/0104711 A1 Aug. 8, 2002

Related U.S. Application Data

(60) Provisional application No. 60/267,227, filed on Feb. 7, 2001.

(51) Int. Cl.[7] ..... A62B 1/16
(52) U.S. Cl. ..... 182/192; 182/5
(58) Field of Search ..... 182/5, 192, 193; 24/115 K; 294/74; 403/209, 210

(56) References Cited

U.S. PATENT DOCUMENTS 421,120 A * 2/1890 Young
502,962 A * 8/1893 Green
830,134 A * 9/1906 Cook
1,117,656 A * 11/1914 Frederick
1,550,900 A * 8/1925 Goodspeed
1,729,945 A * 10/1929 Holm
1,835,068 A * 12/1931 Livermore
2,189,671 A * 2/1940 Mardis
2,225,865 A * 12/1940 Harris
2,946,619 A * 7/1960 Wahl
3,998,561 A * 12/1976 Rohland
4,139,956 A * 2/1979 Sharrow
4,667,772 A 5/1987 Kammerer
5,060,758 A 10/1991 Ishioka
5,113,551 A * 5/1992 Roberts
5,310,274 A * 5/1994 Arakawa
5,383,259 A 1/1995 McIntire
5,735,329 A 4/1998 Akins et al.
5,839,541 A * 11/1998 Jeron ..... 182/192
5,947,229 A 9/1999 Hede et al.
6,059,335 A 5/2000 Matson

OTHER PUBLICATIONS

International Search Report dated May 29, 2002, Application No. PCT/US02/03563, filed Feb. 7, 2002 ( Applicant: Steve Nichols).

* cited by examiner

*Primary Examiner*—Alvin Chin-Shue
(74) *Attorney, Agent, or Firm*—Christensen O'Connor Johnson Kindness PLLC

(57) ABSTRACT

A Prusik knot has several helical wraps around a tether line or a lifeline, a longitudinal loop extending over the wraps, and free end portions tucked or threaded under the loop. A special cover encases the free end portions of the knot.

14 Claims, 5 Drawing Sheets

SAFETY ROPE GRAB DEVICE

CROSS-REFERENCE TO RELATED APPLICATION

This application claims the benefit of U.S. Provisional Application No. 60/267,227, filed on Feb. 7, 2001.

FIELD OF THE INVENTION

The present invention relates to a safety device which is carried by a lifeline or tether line and which will hold fast when weighted, but which is slidable along the lifeline or tether line when unweighted.

BACKGROUND OF THE INVENTION

FIG. 1 illustrates a form of Prusik knot 10, also known as a triple sliding hitch or "monkey fist." Such a knot can be used in fall arrest safety systems which include a lifeline or tether line 12 having one end portion 14 adapted for connection to an anchoring device. For example, one end of the lifeline 12 can be formed with a sturdy eye 16 for receiving a carabiner 18 which, in turn, is secured to the eye of a roof anchor. The lifeline hangs from the anchor. The Prusik knot, when unweighted, can be slid along the lifeline as desired. A termination knot 20 can be provided to limit the extent of sliding movement of the Prusik knot along the lifeline.

In general, the Prusik knot can be formed of a single stretch of rope having several wraps 22 around the lifeline 12. The free end portions 24 of the rope are tucked through the longitudinally extending portion of a loop 26. In the embodiment illustrated in FIG. 1, the free ends of the rope are threaded through rings 28 of a thimble 30 which forms a central eye 32, and then are hand tied to form the end knot 33. A carabiner 34 is carried in the eye 32 and can be connected by a lanyard to a worker's harness. In normal use, with little or no weight applied to the eye portion of the Prusik knot, the wraps 22 can be slid along the lifeline to a desired position. If substantial weight is applied to the eye, such as by way of the carabiner 34, the knot holds fast on the lifeline.

There are a myriad of regulations and specifications for fall arrest safety equipment. For the design shown in FIG. 1, the Prusik knot should contain at least six wraps 22. However, sometimes the knot will be unfastened by sliding the thimble 30 and rope ends 24 through the loop 26, resulting in fewer wraps 22 on the lifeline 12. The entire knot can be unfastened in this manner. Also, there can be concerns with respect to the type of connection from a user's harness and/or lanyard to the eye 32. It is generally preferred that a large loop carabiner 34 be used, but sometimes a snap hook having a smaller opening will be connected to the thimble. In that case, a twisting force of the snap hook in the thimble eye may disengage the hook by damaging the swinging clasp of the snap hook. Also, in the construction of FIG. 1, some protection is formed for the inside portion of the rope loop around the thimble, but the exterior portion is exposed and may become frayed. Further, in fall arrest systems it is desirable for an integral component such as a the Prusik knot to be replaced if it has been subjected to the substantial force of a fall, but whether or not the knot has been subjected to such a force is not immediately ascertainable. Finally, it is possible for the hand tied knot 33 to become loosened over time, requiring frequent and careful inspection if the safety system utilizing the knot is to be reliable.

SUMMARY OF THE INVENTION

The present invention provides an improved rope grab device operating on the principles of a Prusik knot. In a preferred embodiment, a casing or cover is provided for the free end portions of the stretch of rope forming the knot. The cover can be formed of complimentary halves defining an internal cavity receiving the free end portions of the knot. One free end portion is much longer than the other and is looped in an internal channel to form a bight. This end portion can be secured to the other end portion, such as by a swage. The cover can completely encase the end portions of the knot so that they are not subjected to cutting or fraying, and can assist in reliably securing the free end portions of the knot without hand tying. In other aspects of the invention, the cover permits convenient and reliable interconnection with other components without compatibility problems such as can occur with certain snap hooks. The cover can be formed to provide a reliable indication of a strong force having been exerted on the safety device, and to lessen the likelihood of the knot unraveling.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
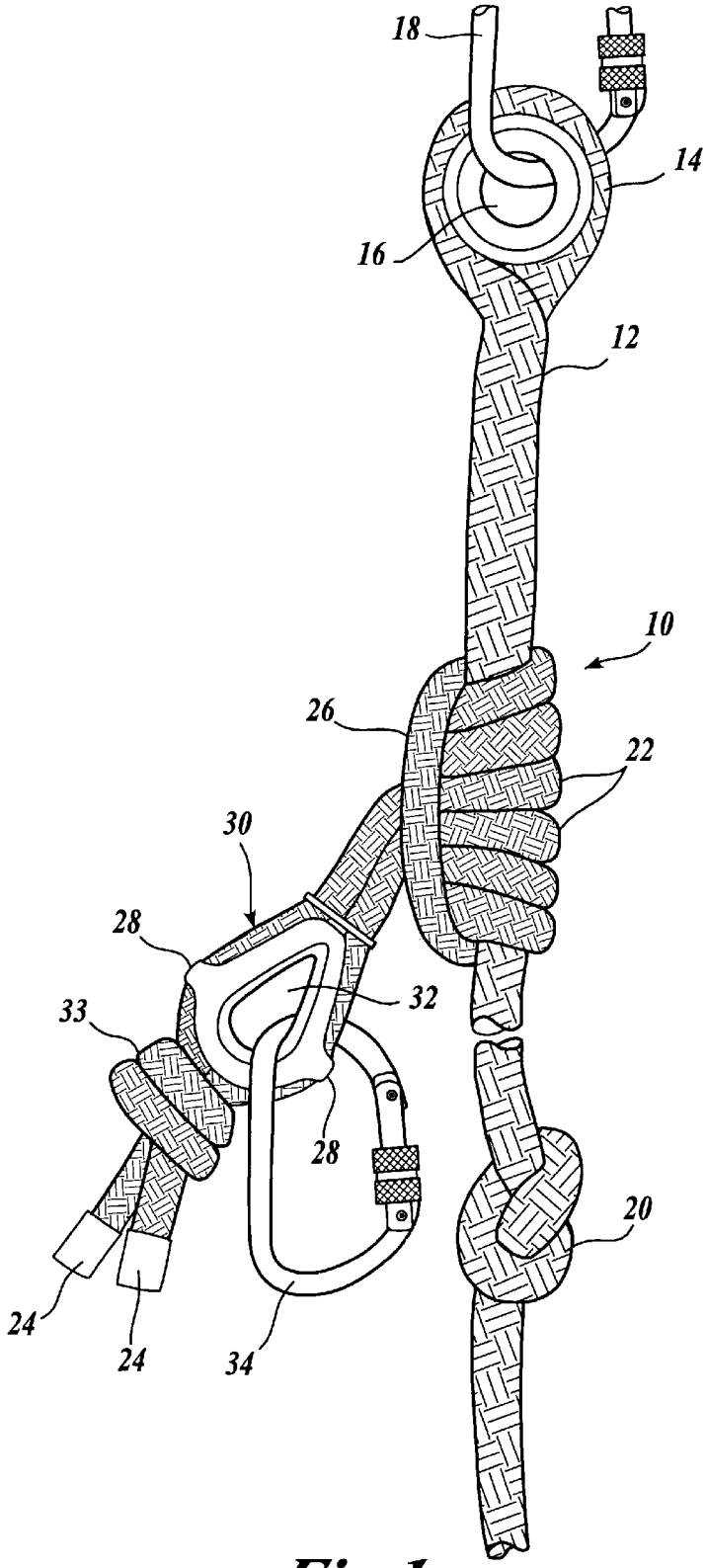
Fig.1. ( PRIOR ART)
FIG. 1 (prior art) is a side elevation of components of a fall arrest safety system having a known rope grab device, namely, a Prusik knot.
Figure 2:
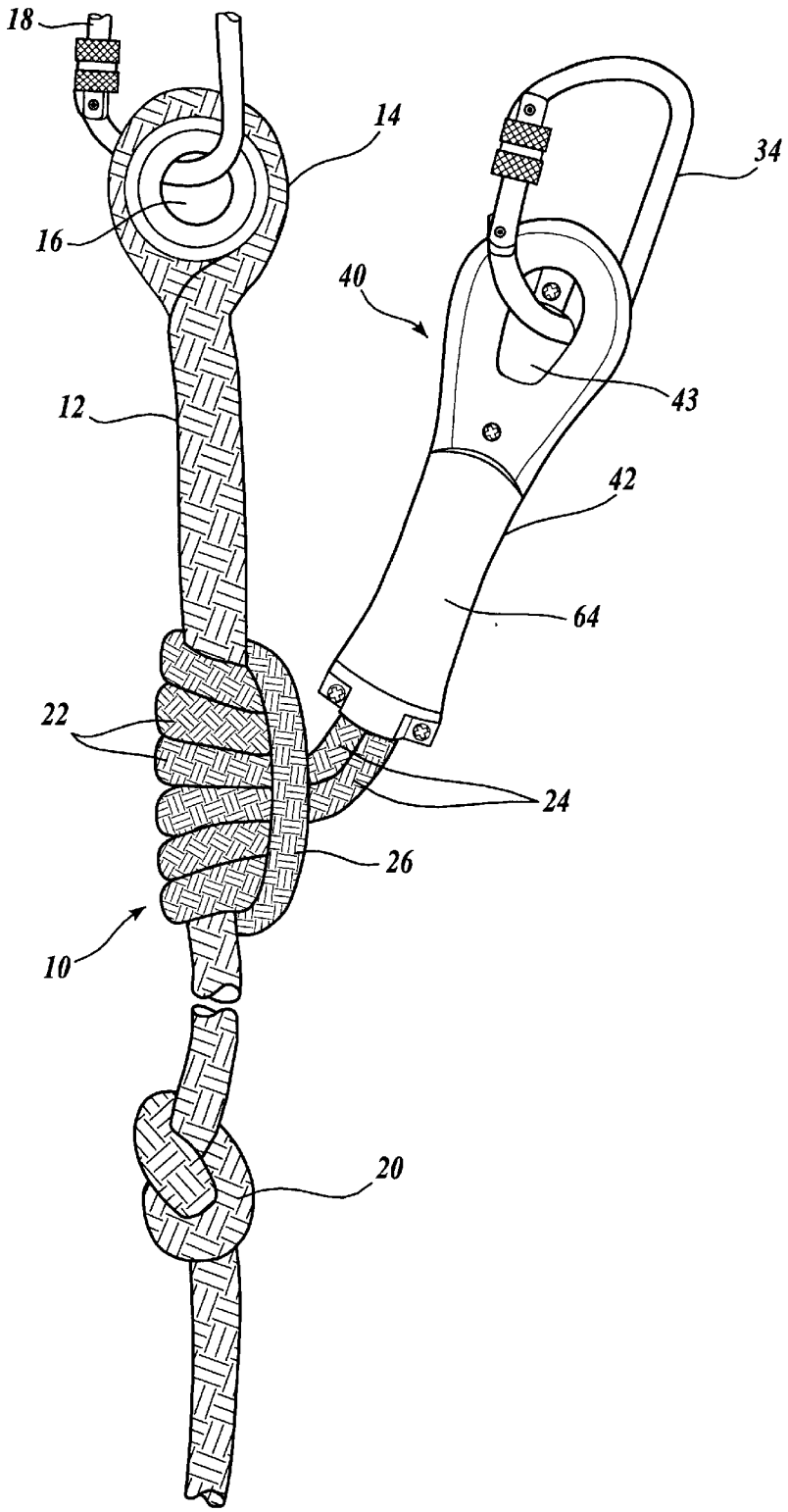
FIG. 2 is a side elevation of a rope grab device in accordance with the present invention, using a terminal casing or cover.

The improved rope grab device in accordance with the present invention can be used for any system in which it is desired to have a strong, reliable device which will hold fast to a line when weighted but be slidable along the line when unweighted. For example, components of a fall arrest safety system in which the rope grab device of the present invention may be used are illustrated in FIG. 2. These components correspond generally to components of the system shown in FIG. 1. A lifeline or tether line 12 has an end termination 14 adapted for connection to a safety anchor, such as by provision of an eye 16 to receive a carabiner 18. The rope grab device 40 of the present invention can, when unweighted, be slid along the lifeline to a desired location. A termination knot 20 may be provided to prevent the rope grab device 40 from inadvertently being slid off the end of the line 12.

The rope grab device 40 includes a Prusik knot 10 having several generally helical wraps 22 around the line 12, and the longitudinal loop 26 through which the free end portions 24 of the knot rope are threaded or tucked. However, rather than terminating in a hand tied knot, the free end portions 24 of the Prusik knot are secured within a casing or cover 42. Cover 42 has an eye 43 designed for receiving a connection device such as carabiner 34. The carabiner can, in turn, be connected to a body harness, such as by way of a lanyard.

The size of the cover 42 prevents it from being slipped back through the loop 26. Also, the cover completely encloses the end portions 24 of the stretch of rope forming the Prusik knot.

Figure 3:
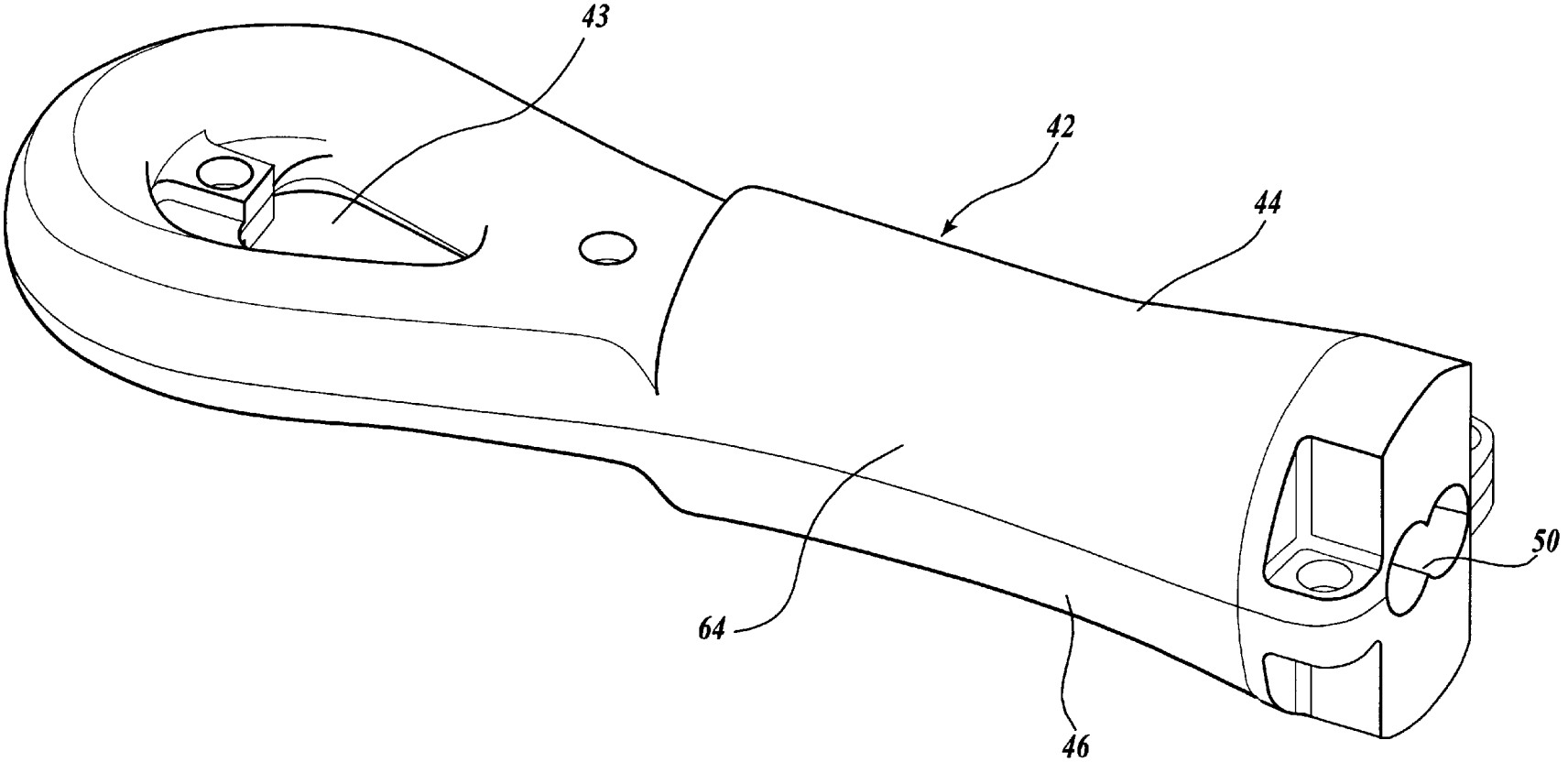
FIG. 3 is a top perspective of a cover in accordance with the present invention.
Figure 4:
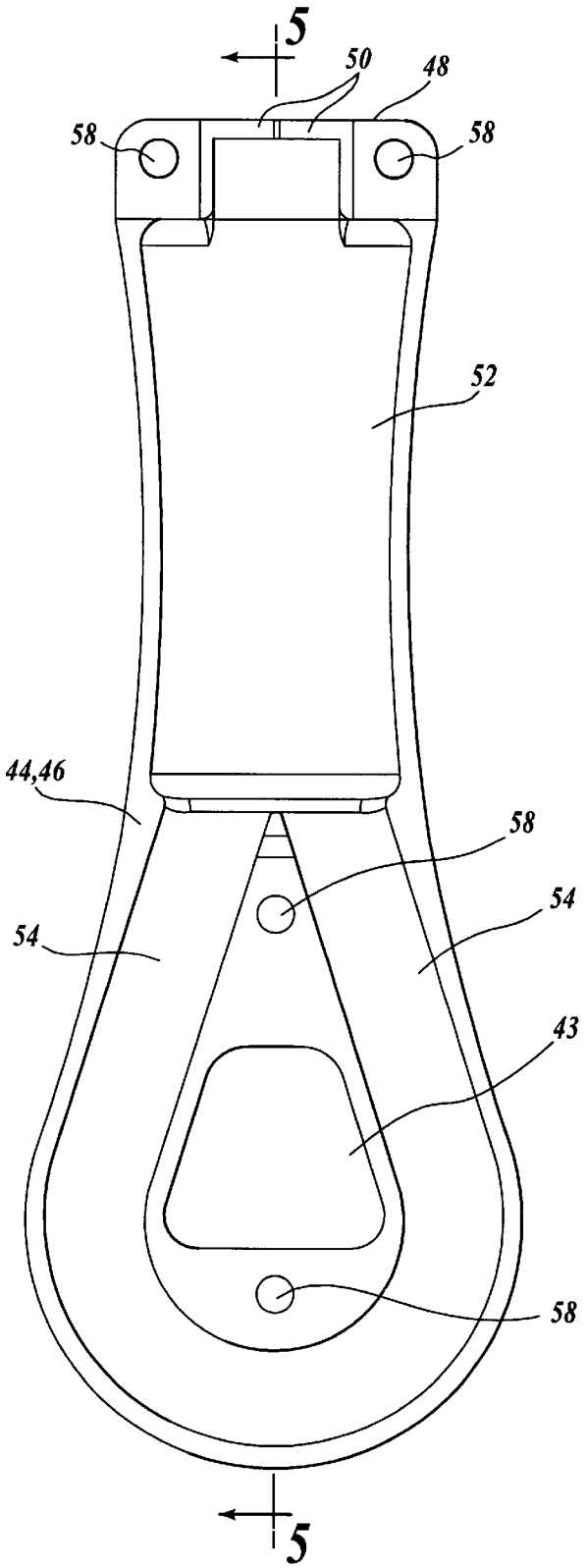
FIG. 4 is a top plan of part of the cover of FIG. 3.
Figure 5:
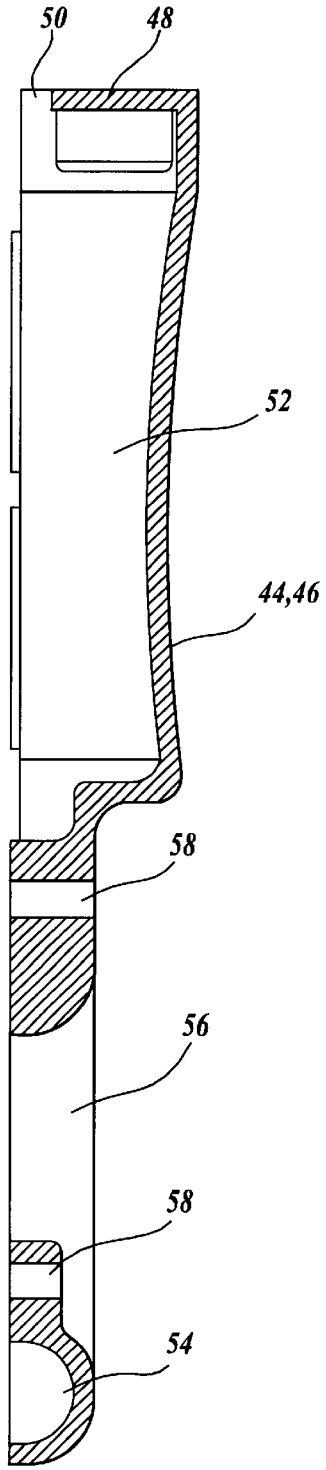
FIG. 5 is a section along line 5—5 of FIG. 4.

With reference to FIGS. 3–5, the cover 42 can be formed with upper and lower halves 44 and 46. One such half is shown in FIGS. 4 and 5. Each cover half 44, 46 has a near or proximate end 48 with openings 50 contoured to receive the rope ends 24. Openings 50 lead to a larger interior cavity 52 and a generally oval channel 54 of approximately semi-circular cross section. The channel encircles the eye 43. The two halves of the cover are nearly identical, the only difference being that one half has holes 58 for externally threaded fasteners and the other half preferably has internally threaded inserts in the form of nuts for receiving the threaded fasteners.

Figure 6:
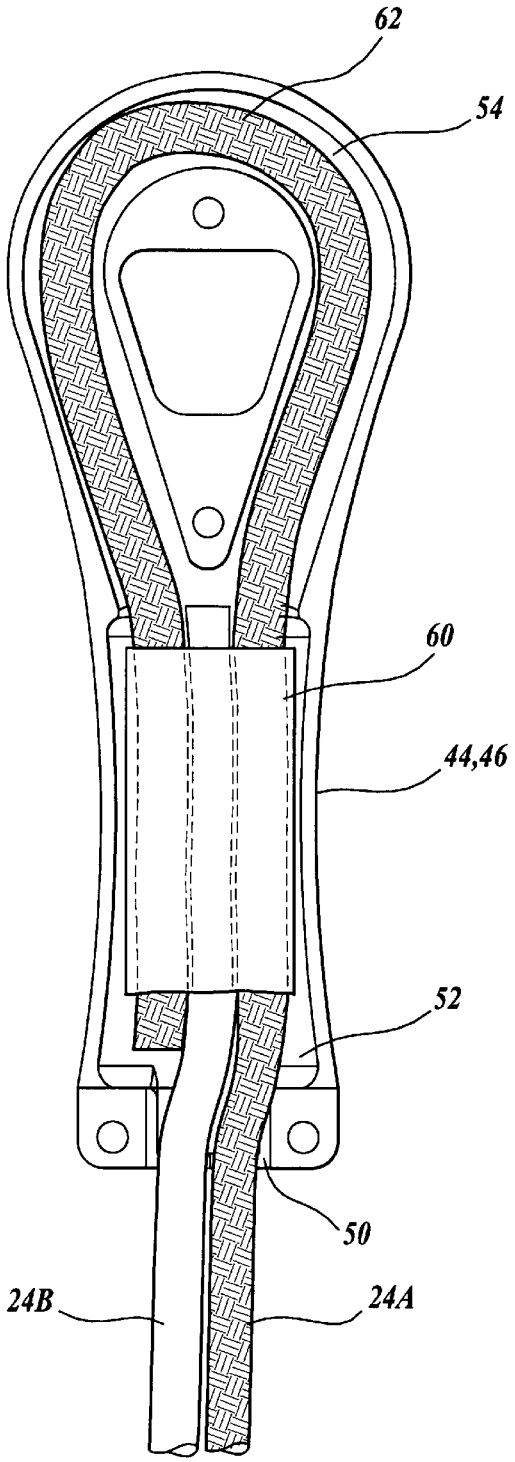
FIG. 6 is a diagrammatic top plan of a cover in accordance with FIG. 4, showing the interconnection of the casing with the free ends of a stretch of rope extending from a Prusik knot.

The two halves will be secured together by the nuts and fasteners to the condition shown in FIG. 3, but only after securing and routing of the rope ends 24 as shown in FIG. 6. In FIG. 6, one rope end 24A is shown textured while the other end 24B is drawn white (not textured) for ease of illustration. End 24A is at least twice as long as end 24B. Each end extends through a swage 60 which initially is cylindrical but which is crimped in a die for tightly grasping the free ends 24. End 24B, drawn white in FIG. 6, extends through the central portion of the swage with a small part projecting from the other end. The other rope end 24A, drawn textured, extends through the swage, in the same direction as the first end 24B, then forms a bight or loop 62 in the channel 54 and extends back through the swage. The three rope sections extend alongside each other and are secured together by crimping the swage. The internal cavity 52 of the combined cover 44, 46 is sized to snugly receive the swage therein. The size of the bight 62 is selected to match the length of the internal channel 54 of the cover, and the openings 50 of the cover are sized to snugly receive the rope ends 24A, 24B.

With the rope ends swaged together as shown in FIG. 6 (the swage 60 being positioned in the cavity 52), and with the bight 62 routed in the channel 54, the two halves are secured together by the fasteners. At that point, the cover and Prusik knot will appear as shown in FIG. 2. The cover has a convenient handle portion 64 which is sized and contoured for convenient manipulation of the Prusik knot along the lifeline 12. The opposite end portion forms the eye 43, which deliberately is quite small and set inward from the outer periphery of the cover. This prevents inappropriate snap hooks from being secured to the cover, which could be dangerous. The overall size and length of the cover prevent it from being passed back under the loop 26, so that the improved safety device cannot be removed from the lifeline without either sliding it off an end or severing the Prusik knot.

Another advantage of the cover is that it can be formed of a tough, abrasion resistant material, but with its strength selected so as to bend or break in the event of a large force being applied (in excess of a predetermined force), as would occur when arresting a fall. Structural integrity of the device for halting a fall is based on the rope characteristics, rather than the cover. The cover forms a convenient indicator or telltale for excessive force having been applied at one time or another to the device, which indicates that it should be replaced in accordance with current regulations.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A rope grab system comprising:

a tether line;

an associated Prusik knot on the tether line, the Prusik knot having a series of wraps around the tether line, a loop extending longitudinally of the tether line-over the wraps and free end portions extending from the wraps and beneath the longitudinal loop; and a cover including an eye and encasing the free end portions of the knot beyond the longitudinal loop, the cover having an internal cavity offset from the eye, and the free ends of the knot having adjacent portions extending alongside each other and secured together within in the cavity.

2. The system defined in claim 1, including a swage securing the adjacent portions of the free ends of the knot together, the swage being received within the cavity.

3. The system defined in claim 1, in which the cover has a rope receiving internal channel surrounding the eye, one free end portion of the knot including a bight extending around the eye and through the channel.

4. The system defined in claim 1, in which the cover includes a near end portion having openings through which the free end portions of the knot pass, an internal cavity adjacent to the near end portion, the adjacent portions of the free ends of the knot being secured together within the cavity, the cover including a far end portion having the eye, the far end portion having a rope receiving channel around the eye communicating with the internal cavity, one free end portion of the knot including a bight received in the channel.

5. The system defined in claim 4, in which the cover is formed of complementary halves secured together by fasteners, for routing of the rope in the cover prior to securing the fastener halves together.

6. The system defined in claim 4, in which the cover has a handle portion between the longitudinal loop and the eye for grasping by a user.

7. The system defined in claim 1, in which the cover is adapted for connection to a user and is formed of a material that will deform when force indicative of a fall arrest in excess of a predetermined force is applied thereto for ready indication of application of such a force by arrest of a fall of a user.

8. A rope grab system comprising:

a tether line;

an associated Prusik knot on the tether line, the Prusik knot having a series of wraps around the tether line, a loop extending longitudinally of the tether line over the wraps and first and second free end portions extending side by side from the wraps and beneath the longitudinal loop;

and a cover encasing the free end portions of the knot beyond the longitudinal loop, the cover having a near end portion including at least one opening through which the first and second free end portions of the knots pass, a far end portion having an eye and a rope receiving internal channel surrounding the eye, the first free end portion of the knot entering the cover through the opening of the near end portion of the cover and extending through the channel to form a bight around the eye, the first free end portion terminating adjacent to the near end portion of the cover and extending alongside a section entering the cover, the second free end portion of the knot entering through the near end portion of the cover, extending alongside the first free end portion and being secured therein to the first free end portion.

9. The system defined in claim 8, in which the bight of the first free end portion of the knot is completely enclosed within the internal channel of the cover.

10. The system defined in claim 8, in which the near end portion of the cover includes an internal cavity receiving the first and second free end portions of the knot and within which the first and second free end portions of the knot are secured together.

11. The system defined in claim 10, including a swage securing the first and second free end portions of the knot together, the swage being received within the cavity.

12. The system defined in claim 10, in which the cover is formed of complementary halves secured together by fasteners, the complementary halves defining the cavity and the channel.

13. The system defined in claim 8, in which the near end portion of the cover forms a handle between the longitudinal loop of the Prusik knot and the eye of the cover for grasping by a user.

14. The system defined in claim 8, in which the cover is adapted for connection to a user and is formed of a material that will deform when force indicative of a fall arrest in excess of a predetermined force is applied thereto for ready indication of application of such force by arrest of a fall of a user.

* * * * *

UNITED STATES PATENT AND TRADEMARK OFFICE

CERTIFICATE OF CORRECTION

PATENT NO. : 6,712,181 B2
DATED : March 30, 2004
INVENTOR(S) : S. Nichols

It is certified that error appears in the above-identified patent and that said Letters Patent is hereby corrected as shown below:

Column 4,
Line 28, “line-over” should read -- line over --
Line 29, “and free” should read -- and first and second free --
Line 29, “end portions” should read -- ends --
Line 34, “free ends” should read -- free abutting ends --

Column 5,
Line 23, “alongside the first free” should read -- alongside and abutting the first free --

Signed and Sealed this

Thirteenth Day of July, 2004

JON W. DUDAS
*Acting Director of the United States Patent and Trademark Office*